United States Patent [19]

Erdman

[11] Patent Number: 4,615,826

[45] Date of Patent: Oct. 7, 1986

[54] HYDROCARBON SOLUBLE NITROGEN CONTAINING DISPERSANT-FLUOROPHOSPHORIC ACID ADDUCTS

[75] Inventor: Timothy R. Erdman, San Rafael, Calif.

[73] Assignee: Chevron Research Company, San Francisco, Calif.

[21] Appl. No.: 745,566

[22] Filed: Jun. 17, 1985

Related U.S. Application Data

[63] Continuation-in-part of Ser. No. 534,858, Sep. 22, 1983, abandoned.

[51] Int. Cl.[4] ..... C10M 131/00; C10M 133/00

[52] U.S. Cl. ..... 252/32.5; 548/413

[58] Field of Search ..... 252/32.5; 548/413

[56] References Cited

U.S. PATENT DOCUMENTS

| | | | |
|---|---|---|---|
| 3,422,017 | 1/1969 | Dadura et al. | 252/49.0 |
| 3,502,677 | 3/1970 | LeSeur | 252/32.5 X |
| 3,609,077 | 9/1971 | Breitigaw et al. | 252/32.5 |
| 4,338,205 | 7/1982 | Wisctsky | 252/32.5 |
| 4,379,064 | 4/1983 | Cengel et al. | 252/51.5 |

*Primary Examiner*—William R. Dixon, Jr.
*Assistant Examiner*—Cynthia A. Prezlock
*Attorney, Agent, or Firm*—S. R. LaPaglia; R. C. Gaffney; G. F. Swiss

[57] ABSTRACT

Amine-containing dispersants, such as succinimides, Mannich Bases and Viscosity-index improvers are reacted with fluorophosphoric acid. The reaction of the dispersant with the fluorophosphoric acid passivates the dispersant to fluorocarbon compositions used as seals, for example in automobile engines.

9 Claims, No Drawings

HYDROCARBON SOLUBLE NITROGEN CONTAINING DISPERSANT-FLUOROPHOSPHORIC ACID ADDUCTS

CROSS-REFERENCE TO RELATED APPLICATIONS

This application is a continuation-in-part of pending application, U.S. Ser. No. 534,858, filed on Sept. 22, 1983 and now abandoned.

FIELD OF THE INVENTION

This invention relates to amine-containing dispersants which have a reduced tendency to attack fluoro-hydrocarbon-type engine seals, and lubricating oil compositions containing said dispersants.

More particularly, this invention relates to adducts prepared from dispersants containing basic nitrogen groups and fluorophosphoric acid and to lubricating oils containing said adducts.

BACKGROUND OF THE INVENTION

Flourocarbon elastomers are commonly used in assembling internal combustion engines. The seals are used to prevent leakage of lubricants at the point where moving parts, such as the crankshaft, leaves the engine. It is well known that the fluorocarbon elastomers are subject to attack by basic amine compounds which are usually present in lubricating oil compositions. This attack consists of base-promoted dehydrofluorination and cross-linking of the elastomer leading to, in essence, further curing of the material. This attack by the dispersants cause a loss of both elasticity and tensile strength in the elastomer. The seal eventually deteriorates to a point to where it fails to adequately prevent leakage of the lubricant from the crankcase.

U.S. Pat. No. 3,422,017 discloses load carrying oil additives which are the reaction product of primary, secondary or tertiary monoamines containing up to 30 carbon atoms and fluorophosphoric acid. U.S. Pat. No. 4,379,064 teaches a method of mild oxidation of basically reacting polyamine crankcase dispersants in order to passivate the dispersant to fluorocarbon compositions used in engines.

The passivation of the dispersant is accomplished by reducing the TBN of the dispersant by 50% to 90% of its original value.

It has now been discovered that dispersants containing basic nitrogen groups may be passivated to fluorocarbon elastomers used in engines by reacting said dispersants with a fluorophosphoric acid.

SUMMARY OF THE INVENTION

It has now been found that a lubricating oil additive can be prepared by reacting a basic nitrogen-containing dispersant composition and a fluorophosphoric acid or ammonium salt thereof.

More particularly, this invention is directed to a hydrocarbon-soluble fluorophosphoric acid adduct which comprises the reaction product of:

(a) a basic nitrogen compound selected from the group consisting of a succinimide, Mannich base, dispersant viscosity index improvers or mixtures thereof; and (b) a fluorophosphoric acid or ammonium salt thereof wherein the amount of said fluorophosphoric acid or salt thereof is from about 0.1 to 1 equivalent per equivalent of basic nitrogen atom. Another embodiment of this invention is directed to lubricating oil compositions comprising an oil of lubricating viscosity and effective dispersancy providing amount of said fluorophosphoric acid adduct.

DETAILED DESCRIPTION OF THE INVENTION

Lubricating oil compositions containing the additive prepared as disclosed herein, provides dispersancy to the oil while at the same time does not cause deterioration of fluorocarbon engine seals and the associated leak of lubricant from the crankcase. It has further been found that lubricating oil compositions containing the fluorophosphoric acid adducts of this invention enhance the wear protection provided by the lubricating compositions.

The precise molecular formula of the fluorophosphoric acid adducts of this invention is not known with certainty; however, they are believed to be compounds in which a fluorophosphoric acid is either complexed by or as the salt of one or more nitrogen atoms of the basic nitrogen-containing compositions used in the preparation of these compositions.

The fluorophosphoric acids employed in the formation of the compounds of the present invention are prepared by the general methods described on pages 779 to 786 of Volume 10 of the Encyclopedia of Chemical Technology by R. E. Kirk and Orthmer, published by The Interscience Encyclopedia, Inc., New York, N.Y., 1980.

The dispersant compound of this invention must have a basic nitrogen content as measured by ASTM D-664 or D-2896. It is preferably oil-soluble. Typical of such compositions are succinimides, Mannich bases, dispersant viscosity index improvers, and mixtures thereof. These basic nitrogen-containing compounds are described below (keeping in mind the reservation that each must have at least one basic nitrogen). These aftertreatments are particularly applicable to succinimides and Mannich base compositions.

The mono- and polysuccinimides that can be used to prepare the lubricating oil additives described herein are disclosed in numerous references and are well known in the art. Certain fundamental types of succinimides and the related materials encompassed by the term of art "succinimide" are taught in U.S. Pat. Nos. 3,219,666, 3,172,892 and 3,272,746, the disclosures of which are hereby incorporated by reference. The term "succinimide" is understood in the art to include many of the amide, imide, and amidine species which are also formed by this reaction. The predominant product, however, is a succinimide and this term has been generally accepted as meaning the product of a reaction of an alkenyl substituted succinic acid or anhydride with a nitrogen-containing compound.

Polyamines are preferred for preparing the succinimide dispersant. Among the polyamines are alkylene polyamines (and mixtures thereof) including those having the formula:

$$A-\underset{\underset{A}{|}}{N}\left(R-\underset{\underset{A}{|}}{N}\right)_n H$$

wherein n is an integer between 1 and about 10, preferably, between 2 and 8; each A can be independently hydrogen or a hydrocarbon or hydroxy-substituted hydrocarbon radical which can be derived from an alkylene oxide compound, having up to about 30 atoms; and R is a divalent hydrocarbon radical having from about 1 to about 18 carbons. A can be an aliphatic radical of up to about 10 carbon atoms which may be substituted with one or two hydroxy groups, and R is a lower alkylene radical having 1–10, preferably 2–6 carbon atoms. Preferred polyamines are the alkylene polyamines wherein each A is hydrogen. Such alkylene polyamines incude methylene polyamines, ethylene polyamines, butylene polyamines, propylene polyamines, pentylene polyamines, hexylene polyamines and heptylene polyamines. The higher homologs of such amines and related aminoalkyl-substituted piperazines are also included. Specific examples of such polyamines include ethylene diamine, triethylene tetramine, tris(2-aminoethyl)amine, propylene diamine, trimethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, 2-heptyl-3-(2-aminopropyl)-imidazoline, 1,3-bis-(2-aminoethyl)imidazoline, 1-(2-aminopropyl)-piperazine, 1,4-bis(2-aminoethyl)-piperazine and 2-methyl-1(2-aminobutyl)-piperazine. Higher homologs, obtained by condensing two or more of the above-illustrated alkylene amines, are also useful, as are the polyoxyalkylene polyamines (e.g., "Jeffamines").

The ethylene polyamines, examples of which are mentioned above, are especially useful for reasons of cost and effectiveness. Such polyamines are described in detail under the heading "Diamines and Higher Amines" in Kirk-Othmer, Encyclopedia of Chemical Technology, Second Edition, Vol. 7, pp. 22–39. They are prepared most conveniently by the reaction of an alkylene chloride with ammonia or by reaction of an ethylene imine with a ring-opening reagent such as ammonia. These reactions result in the production of the somewhat complex mixtures of alkylene polyamines, including cyclic condensation products such as piperazines. Because of their availability, these mixtures are particularly useful in preparing the nitrogen-bridged dispersant. Satisfactory products can also be obtained by the use of pure alkylene polyamines.

Hydroxy polyamines, e.g., alkylene polyamines having one or more hydroxyalkyl substituents which can be derived from the alkylene oxide on the nitrogen atoms, are also useful in preparing the nitrogen-bridged dispersant. Preferred hydroxyalkyl-substituted alkylene polyamines are those in which the hydroxyalkyl group has less than about 10 carbon atoms. Examples of such hydroxyalkyl-substituted polyamines include N-(2-hydroxyethyl)ethylene diamine, N,N'-bis(2-hydroxyethyl)-ethylene diamine, 1-(2-hydroxyethyl)piperazone, monohydroxypropyl-substituted diethylene triamine, dihydroxypropyltetraethylene pentamine and N-(3-hydroxybutyl)tetramethylene diamine. Higher homologs obtained by condensation of the above-illustrated hydroxyalkyl-substituted alkylene amines through amino radicals or through hydroxy radicals are likewise useful.

Preferred succinimides, because of their commercial availability, are those succinimides prepared from a hydrocarbyl succinic anhydride, wherein the hydrocarbyl group contains from about 50 to about 350 carbon atoms, and an ethylene amine, said ethylene amines being especially characterized by ethylene diamine, diethylene triamine, triethylene tetramine, and tetraethylene pentamine. Particularly preferred are those succinimides prepared from polyisobutenyl succinic anhydride of 70 to 128 carbon atoms and tetraethylene pentamine or triethylene tetramine or mixtures thereof.

Another class of compounds useful for supplying basic nitrogen are the Mannich base compositions. These compositions are prepared from a phenol or $C_{9-200}$ alkylphenol, an aldehyde, such as formaldehyde or formaldehyde precursor such as paraformaldehyde, and an amine compound. The amine may be a mono- or polyamine and typical compositions are prepared from an alkylamine, such as methylamine or an ethylene amine, such as, diethylene triamine, or tetraethylene pentamine. The phenolic material may be sulfurized and preferably is a $C_{40-100}$ alkylphenol and most preferably is dodecylphenol. Typical Mannich bases which can be used in this invention are disclosed in U.S. Pat. No. 4,157,309, and U.S. Pat. Nos. 3,649,229, 3,368,972 and 3,539,663, the disclosures of which are hereby incorporated by reference. The last application discloses Mannich bases prepared by reacting an alkylphenol having at least 50 carbon atoms, preferably 50 to 200 carbon atoms with formaldehyde and an alkylene polyamine $HN(DNH)_xH$ where D is a saturated divalent alkyl hydrocarbon of 2 to 6 carbon atoms and x is 1–10 and where the condensation product of said alkylene polyamine may be further reacted with urea or thiourea. The Mannich base may be borated by reacting with, e.g., a boron halide, boric acid or an ester of boric acid.

Another class of nitrogen-containing compositions useful in preparing the compositions of this invention includes the so-called dispersant viscosity index improvers (VI improvers). These VI improvers are commonly prepared by functionalizing a hydrocarbon polymer, especially a polymer derived from ethylene and/or propylene, optionally containing additional units derived from one or more co-monomers such as alicyclic or aliphatic olefins or diolefins. The functionalization may be carried out by a variety of processes which introduce a reactive site or sites which usually has at least one oxygen atom on the polymer. The polymer is then contacted with a nitrogen-containing source to introduce nitrogen-containing functional groups onto the polymer backbone. Commonly used nitrogen sources include any basic nitrogen compound especially those nitrogen compounds and compositions described herein. Preferred nitrogen sources are alkylene amines, such as ethylene amines, alkyl amines, and Mannich bases. Dispersants of these types are disclosed in U.S. Pat. Nos. 3,769,216, 3,872,019, 3,687,905 and 3,785,980, the disclosures of which are incorporated herein by reference.

Preferred basic nitrogen compounds for use in this invention are succinimides, and Mannich bases.

In the reaction mixture, the ratio of fluorophosphoric acid or ammonium salt to basic nitrogen compound is in the range of from 0.1 to 1 equivalent of acid or ammonium salt per equivalent of basic nitrogen compound. Preferably, from 0.4 to 1.0, and most preferably from 0.4 to 0.7, equivalents per equivalent of basic nitrogen is added to the reaction mixture.

The lubricating oil compositions containing the additives of this invention can be prepared by admixing, by conventional techniques, the appropriate amount of the hydrocarbon-soluble fluorophosphoric acid adduct composition with a lubricating oil. The selection of the particular base oil depends on the contemplated application of the lubricant and the presence of other additives. Generally, the amount of the additive will vary from 0.1 to 15% by weight and preferably from 0.2 to 10% by weight.

The lubricating oil which may be used in this invention includes a wide variety of hydrocarbon oils, such as naphthenic bases, paraffin bases and mixed base oils as well as synthetic oils such as esters and the like. The lubricating oils may be used individually or in combination and generally have a viscosity which ranges from 50 to 5,000 SUS and usually from 100 to 15,000 SUS at 38° C.

In many instances it may be advantageous to form concentrates of the additive within a carrier liquid. These concentrates provide a convenient method of handling and transporting the additives before their subsequent dilution and use. The concentration of the additive within the concentrate may vary from 15 to 85% by weight although it is preferred to maintain a concentration between 15 and 50% by weight. While the preferred use of the additives and compositions of this invention is in the crankcase of internal combustion engines, the final application of the lubricating oil compositions of this invention may be in marine cylinder lubricants as in cross-head diesel engines, crankcase lubricants as in railroads, lubricants for heavy machinery such as steel mills and the like, or as greases for bearings and the like and in transmission fluids. Whether the lubricant is fluid or a solid will ordinarily depend on whether a thickening agent is present. Typical thickening agents include polyurea acetates, lithium stearate and the like.

If desired, other additives may be included in the lubricating oil compositions of this invention. These additives include antioxidants or oxidation inhibitors, dispersants, rust inhibitors, anti-corrosion agents and so forth. Also anti-foam agents stabilizers, anti-stain agents, tackiness agents, anti-chatter agents, dropping point improvers, anti-squawk agents, extreme pressure agents and the like may be included.

The invention is further illustrated by, but not limited to, the following examples.

EXAMPLES

Example 1

To a 1-liter reaction flask was added 330g (0.1 equiv). of a commercial succinimide dispersant composition (43% actives in diluent oil) prepared from 1 mole polyisobutenyl succinic anhydride (where the polyisobutenyl group has a number average weight of about 980) and 0.87 mole tetraethylenepentamine. The succinimide was diluted with 150 ml toluene and warmed to 100° C. To this mixture was added 16.3g (0.1 mole) ammonium hexafluorophosphate dissolved in 75 ml water over a period of 50 min. Water was removed by azeotroping during the addition. Solvents were removed by stripping to 150° C. and 5 mm Hg. Recovered 341 g product containing 1.90% nitrogen, 0.77% phosphorus and 2.63% fluorine.

Example 2

To a 1-liter reaction flask was added 330 g of a succinimide as described in Example 1 and 200 ml toluene. To this mixture, heated to 90° C., was added 32.6 g (0.2 mole) ammonium hexafluorophosphate dissolved in 100 ml water over a period of one hour. Water was removed by azeotroping during the addition. The remaining water and some toluene was removed by distillation. The product mixture was diluted with hydrocarbon solvent, filtered through Celite, and stripped to 150° C. and 5 mm Hg. Recovered 329 g product containing 1.81% nitrogen, 1.45% phosphorus, and 5.0% fluorine.

Example 3

To a solution of 940 g succinimide dispersant of Example 1 in 1000 ml toluene was added a mixture of 80.0 g commercial aqueous hexafluorophosphoric acid (70% actives based on fluorine) and 34 g concentrated ammonium hydroxide in 80 ml water. The addition was made at 90–95° C. over a period of 50 minutes while removing water by azeotropic distillation. Solvents were removed by distillation to 150° C. The product was dissolved in 500 ml hydrocarbon thinner, filtered through Celite, and stripped to 150° C. and 5 mm Hg. Recovered 958 g product containing 1.94% nitrogen, 1.05% phosphorus, and 3.25% fluorine.

Example 4

To a solution of 94 g succinimide dispersant of Example 1 in 100 ml toluene was added 6.4 g aqueous hexafluorophosphoric acid (70% actives) in 10 ml water. The addition was made at 90° C. over a period of 7 minutes while removing water by azeotropic distillation. The product was stripped to 150° C. and 5 mm Hg. Recovered 100 g product containing 1.86% nitrogen, 1.01% phosphorus, and 3.42% fluorine.

Example 5

To a solution of 94 g succinimide dispersant of Example 1 in 100 ml toluene was added a solution containing 6.3 g commercial aqueous difluorophosphoric acid, 10 ml concentrated ammonium hydroxide, and 10 ml water. The addition was made at 95° C. over a period of 15 minutes while removing water by azeotropic distillation. The reaction mixture was then diluted with hydrocarbon thinner, filtered through Celite, and stripped to 150° C. and 5 mm Hg. Recovered 92 g product containing 1.89% nitrogen, 0.97% phosphorus, and 0.88% fluorine.

Example 6

To a solution of 94 g succinimide dispersant of Example 1 in 100ml toluene was added a solution of 6.3 g commercial aqueous difluorophosphoric acid in 10 ml water. The addition was made at 90° C. over a period of 10 minutes while removing water by azeotropic distillation. Solvents were removed by stripping to 150° C. and 5 mm Hg. Recovered 100 g product containing 1.82% nitrogen, 1.41% phosphorus, and 1.71% fluorine.

Example 7

To a solution of 95 g succinimide dispersant of Example 1 in 100 ml toluene was added a solution containing 5.0g commercial aqueous monofluorophosphoric acid, 5 ml concentrated ammonium hydroxide, and 10 ml water. The addition was made at 95° C. over a period of 15 minutes while removing water by azeotropic distillation. Solvents were removed by stripping to 150° C. and 5 mm Hg. Recovered 99.2 g product containing 1.90% nitrogen, 1.50% phosphorus, and 0.9% fluorine.

Example 8

To a solution of 97 g of a succinimide dispersant composition (50% actives in diluent oil), prepared from 1 mole polyisobutenyl succinic anhydride (where the polyisobutenyl group has a number average molecular weight of about 980) and 0.5 mole tetraethylenepentamine, in 100 ml toluene was added a solution containing 4.7 g aqueous hexafluorophosphoric acid (70% actives), 2.5 ml concentrated ammonium hydroxide, and 5 ml water. The addition was made at 95° C. over a period of 8 minutes while removing water by azeotropic distillation. The reaction mixture was then diluted with 150 ml hydrocarbon solvent, filtered through Celite, and stripped to 150° C. and 7 mm Hg. Recovered 96.5 g product containing 1.20% nitrogen, 0.55% phosphorus, and 1.82% fluorine.

Example 9

To a 1-liter reaction flask was added 215.5 g of an oil solution containing 52% by weight (0.05 equiv.) of a commercial succinimide dispersant, prepared from 1 mole polyisobutenyl succinic anhydride (where the isobutenyl group has a number average molecular weight of about 980) and 0.5 mole triethylenetetramine, and 150 ml of toluene. A solution containing 10.4 g aqueous hexafluorophosphoric acid (70% actives based on fluorine), 5 ml concentrated ammonia hydroxide and 5 ml water was then added at 98° C. over a period of 10 minutes while removing water by azeotropic distillation. Heating was continued to 122° C. taking over 11 ml water and about 39 ml toluene. The reaction mixture was then diluted with 150 ml hydrocarbon thinner, filtered through Celite and stripped to 150° C. and 5 mm Hg. Recovered 207.9 product containing 1.24% nitrogen, 0.49% phosphorus and 1.61% fluorine.

Example 10

A 500-ml reaction flask fitted with a stirrer and Dean Stark trap was charged with 174 g of Amoco 9250 (1.15% N; a borated Mannich dispersant prepared by reacting polyisobutenyl substituted phenol with formaldehyde and polyamine and then borating). While stirring at 100° C., a solution containing 6 g (0.029 mole) 70% $HPF_6$, 3.5 ml $NH_4OH$ and 4 ml $H_2O$ was added to the flask over a period of 5 minutes. The reaction mixture was slowly heated to 140° C. while removing water by azeotropic distillation.

The reaction mixture was then stripped to 150° C. and 5 mm Hg. to yield 179 g of product containing 1.13% nitrogen, 0.45% phosphorus; 0.13% B and 1.78% fluorine.

Example 11

To a 500 ml reaction flask was charged 125 ml of Chevron Thinner 325 which is a mixture of aromatic naphthenes and paraffins and is available from Chevron Chemical Company, Richmond, Calif. and 100 g of a succinimide dispersant composition of Example 1. The pot contents were cooled to about 5° C. and then 8.8 g phosphorous tribromide was added over a period of 10 minutes. The system was heated to 45° C. and stirred there for 30 minutes and then heated to 160° C. and stirred there for 1 hour. Volatiles were removed by stripping the system at 160° C. and reduced pressure (5 mm Hg) yielding 108.3 g of the product composition containing 1.84% nitrogen, 1.09% phosphorous, and 5.21% bromine.

Example 12

To a 500 ml flask was charged 100 g of the dispersant composition of Example 1 and 125 ml of Chevron Thinner 325. The flask contents were cooled to 5° C. and 4.7 g phosphorous trichloride was added over a period of 10 minutes. The reaction mixture was stirred at 45° C. for 0.5 hour, then at 165° C. for another 1 hour. The product was stripped at 175° C. and reduced pressure (5 mm Hg) to give 99.7 g of the product composition containing 1.96% nitrogen, 1.02% phosphorous, and 2.47% chlorine.

Example 13

To a 500 ml flask was charged 100 g of the disperant composition of Example 1 and 125 ml of Chevron Thinner 325. This mixture was stirred at room temperature while 6.7 g phosphorous pentachloride was added over a period of 10 minutes. The reaction mixture was stirred at 55° C. for 0.5 hour, then at 160° C. for 1 hour. The product was stripped at 160° C. and reduced pressure (5 mm Hg) to give a product composition containing 1.98% nitrogen, 1.04% phosphorous and 2.00% chlorine.

Example 14

To a 500 ml flask was charged 100 g of the dispersant composition of Example 1 and 150 ml toluene. This mixture was chilled to 5° C. and 14.1 g phosphorous pentabromide was added over a period of 15 minutes. The reaction mixture was then brought to room temperature (about 23° C.) and stirred for 2 hours. 50 g diluent oil was added and the product stripped at 125° C. and reduced pressure (3 mm Hg) to give a product composition containing 1.33% nitrogen, 0.56% phosphorous, and 4.93% bromine.

Example 15

To a 500 ml flask was charged 100 g of the dispersant composition of Example 1 and 150 ml toluene. This mixture was chilled to 5° C. and 14 g phosphorous pentafluoride was added over a period of 10 minutes. The reaction temperature increased to 22° C. during this addition. The reaction mixture was stirred at room temperature (about 24° C.) for 1 hour. 50 g diluent oil was added and the product stripped at 150° C. and reduced pressure (3 mm Hg) to give a product composition containing 1.33% nitrogen, 1.49% phosphorous, and 4.32% fluorine.

Example 16

Fluoroelastomer Material Compatibility Using ASTM Test Method D471-79 Rubber Property-Effect of Liquids and D412-80 Rubber Properties in Tension.

Specimens of fluoroelastomer material were totally immersed in the candidate oil for 10 days (240 hours) at 150° C. The change in elongation compared to a fluoroelastomer specimen not immersed in oil is measured to determine the fluoroelastomer/oil compatibility. The results are shown in Table I. The oil formulations which were tested were prepared by dissolving 5.25% of each of the dispersants indicated in Table I in a formulated oil containing overbased calcium phenates and sulfonates, a mixture of alkyl zinc dithiophosphates, and a viscosity index improver.

TABLE I

| Dispersant | Change in % Elongation |
|---|---|
| None | −7.0 |
| Succinimide of Example 1 | |
| Before reaction with fluorophosphoric acid | −29.6 |
| After reaction with fluorophosphoric acid | −20.6 |

TABLE I-continued

| Dispersant | Change in % Elongation |
|---|---|
| Succinimide of Example 5 | |
| Before reaction with fluorophosphoric acid | −29.6 |
| After reaction with flourophosphoric acid | −26.5 |
| Succinimide of Example 7 | |
| Before reaction with fluorophosphoric acid | −29.6 |
| After reaction with flourophosphoric acid | −23.9 |
| Succinimide of Example 8 | |
| Before reaction with fluorophosphoric acid | −18.9 |
| After reaction with fluorophosphoric acid | −11.0 |
| Succinimide of Example 9 | |
| Before reaction with fluorophosphoric acid | −19.4 |
| After reaction with fluorophosphoric acid | −13.6 |
| Mannich Base of Example 10 | |
| Before reaction with fluorophosphoric acid | −36.6 |
| After reaction with fluorophosphoric acid | −30.6 |

Example 17

The anti-wear properties of the additives of this invention were demonstrated by Falex Methods - ASTM test 3233. This test measures anti-wear properties of the additives by rating the load carrying properties of the lubricating oil containing the additive. Higher load carrying capacity is reflected by higher seizure loads. Accordingly, higher seizure loads reflect superior additives.

This test was conducted as described in Procedure B of ASTM test 3233 with the expectations that the additive in lubricating oil is first run for 30 seconds without load so specimens are coated with oil and that increments of 50 lbs were utilized rather than 250 lbs.

The product compositions of Examples 1 and 11–15 were tested. The tests were repeated at least twice with several being repeated three times. The results of this test are reported in Table II below:

TABLE II

| Example | halophosphoric acid used to make succinimide adduct | Seizure Load, lbs 1st | 2nd | 3rd | AVG | Improvement over untreated Reference, % |
|---|---|---|---|---|---|---|
| Untreated Succinimide of Example 1 | | 950 | 950 | 950 | 950 | Reference |
| 11 | $PBr_3$ | 1100 | 850 | 850 | 933 | −2% |
| 12 | $PCl_3$ | 1100 | 1050 | — | 1075 | 13% |
| 13 | $PCl_5$ | 1150 | 850 | | | |
| 13a | $PCl_5$ | 1000 | 950 | 1050 | 1000 | 5% |
| 14 | $PBr_5$ | 1050 | 900 | 1050 | 1000 | 5% |
| 15 | $PF_5$ | 4500* | 4500* | — | 4500* | >375% |
| 1** | $NH_4PF_6$ | 4500* | 4500* | — | 4500* | >374% |

*The maximum applied load was 4500 lbs. Compositions of Examples 1 and 15 had yet to result in seizure at this load.

**The wear performance of $NH_4PF_6$/succinimide adducts appears to deteriorate over time possibly due to product deterioration. For instance, an adduct of $NH_4PF_6$/succinimide prepared in a manner similar to that of Example 3 which was stored for greater than 2 years produced the following seizure load values:

| Seizure Load, lbs 1st | 2nd | 3rd | Average | % Improvement over Reference |
|---|---|---|---|---|
| 1400 | 1250 | 1350 | 1333 | 40% |

In any event, these values still demonstrate substantially superior anti-wear properties over either the bromo or chloro analogs.

What is claimed is:

1. A hydrocarbon-soluble fluorophosphoric acid adduct which comprises the reaction product of:

(a) a succinimide having at least one basic nitrogen; and (b) a fluorophosphoric acid or ammonium salt thereof wherein the amount of said fluorophosphoric acid or salt thereof is from about 0.1 to 1 equivalent per equivalent of basic nitrogen atom of said succinimide.

2. The hydrocarbon-soluble fluorophosphoric acid adduct of claim 1 wherein the fluorophosphoric acid is selected from the group consisting of monofluorophosphoric acid, difluorophosphoric acid and hexafluorrophoshporic acid.

3. The hydrocarbon-soluble fluorophosphoric acid adduct of claim 1 wherein the succinimide is a $C_{50-350}$ hydrocarbyl succinimide.

4. The hydrocarbon-soluble fluorphosphoric acid adduct of claim 3 wherein said $C_{50-350}$ hydrocarbyl succinimide is the reaction product of polyisobutenyl succinic anhydride and tetraethylene pentamine or triethylene tetramine.

5. A lubricating oil composition comprising an oil of lubricating viscosity and an effective dispersancy providing amount of the product of claim 1.

6. A process for improving the compatability of a succinimide dispersant with fluorocarbon compositions which comprises reacting:

(a) a succinimide having at least one basic nitrogen; and (b) a fluorophosphoric acid or ammonium salt thereof wherein the amount of said fluorophosphoric acid or salt thereof is from about 0.1 to 1 equivalent per equivalent of basic nitrogen atom of said succinimide.

7. The process as defined in claim 6 wherein said fluorophosphoric acid is selected from the group consisting of monofluorophosphoric acid, difluorophosphoric acid and hexafluorophosphoric acid.

8. The process as defined in claim 6 wherein said succinimide is a $C_{50-350}$ hydrocarbyl succinimide.

9. The process as defined in claim 8 wherein said $C_{50-350}$ hydrocarbyl succinimide is the reaction product of polyisobutenyl succinic anhydride and tetraethylene pentamine or triethylene tetramine.

* * * * *